United States Patent [19]

Goodyear

[11] 4,317,294

[45] Mar. 2, 1982

[54] REPLACEABLE SHOE SOLE

[76] Inventor: Mark V. Goodyear, 3614 S. Marine, Santa Ana, Calif. 92704

[21] Appl. No.: 151,628

[22] Filed: May 20, 1980

[51] Int. Cl.[3] ..... A43B 3/24; A43B 21/36

[52] U.S. Cl. ..... 36/100; 36/36 B

[58] Field of Search ..... 36/16, 100, 101, 36 B, 36/36 C

[56] References Cited

U.S. PATENT DOCUMENTS

| | | | |
|---|---|---|---|
| 2,183,277 | 12/1939 | Heilhecker | 36/100 |
| 2,368,314 | 1/1945 | Mary | 36/101 |
| 2,760,279 | 8/1956 | Jones et al. | 36/101 |
| 3,019,534 | 2/1962 | Kauffman et al. | 36/100 |
| 4,267,650 | 5/1981 | Bauer | 36/101 |

FOREIGN PATENT DOCUMENTS

| | | | |
|---|---|---|---|
| 2725622 | 12/1978 | Fed. Rep. of Germany | 36/16 |

*Primary Examiner*—Patrick D. Lawson

*Attorney, Agent, or Firm*—Knobbe, Martens, Olson, Hubbard & Bear

[57] ABSTRACT

A replaceable shoe sole is comprised of a mid-sole, which is securely attached to the upper portion of the shoe, and an out-sole removeably attached to the mid-sole. The upper surface of the out-sole is provided with a continuous ridge which is snapped into a matching, deformably resilient groove recessed into the bottom surface of the mid-sole. The configuration of the ridge and the resiliency of the out-sole and the mid-sole material, which is preferably a polyurethane resin or foam, permits the out-sole to be easily and selectively removed and replaced by an out-sole having a new or distinctive tread pattern, the replaced out-sole being reusable if desired. The ridge on the out-sole is provided with an undercut portion to provide secure retention of the out-sole in the mid-sole, although the specific cross sectional shape of the ridge may vary depending upon the retentiveness required by a particular activity.

10 Claims, 8 Drawing Figures

Fig. 1
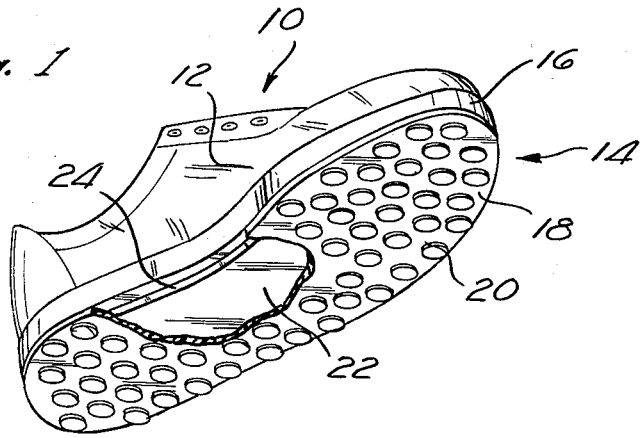
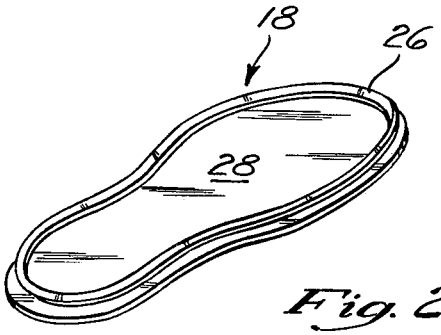
Fig. 2
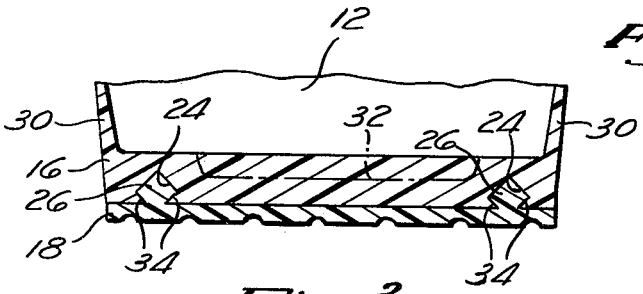
Fig. 3
Fig. 4
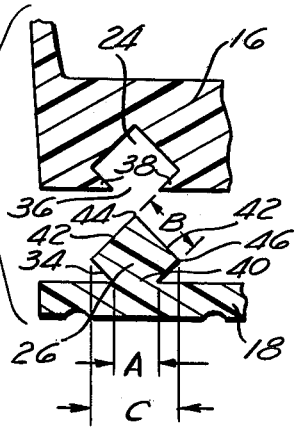
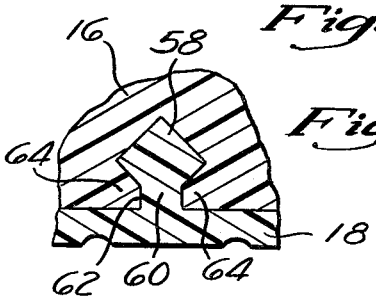
Fig. 6
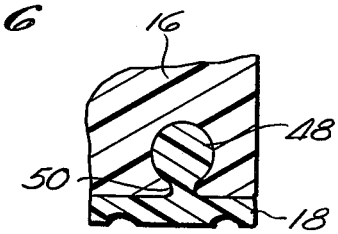
Fig. 5
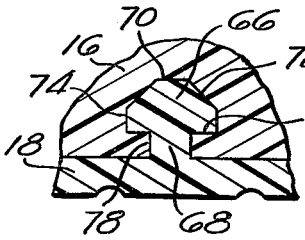
Fig. 7
Fig. 8
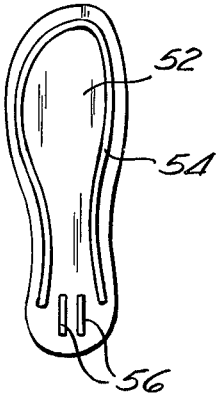

REPLACEABLE SHOE SOLE

BACKGROUND OF THE INVENTION

The present invention relates to a replaceable shoe sole having particular application to an athletic shoe. The two-part sole is comprised of a lower or out-sole portion removeably attached to an upper or mid-sole portion by means of a resilient snap fit between a ridge on the out-sole and a matching groove recessed into the mid-sole.

There has recently been a dramatic upsurge of participation in a wide variety of athletic activities, such a jogging or running, tennis, racquet ball, etc. As a result of this increased popularity of athletics, the public has demanded athletic shoes of a higher quality. Typically, such athletic shoes have an upper portion made from a durable, high quality material, such as leather, and a treaded sole, usually made of rubber. After a certain period of use, however, it is common for the sole of the athletic shoe to become worn, while the upper portion of the shoe is still in relatively good condition.

In order to restore the usefulness of such a worn athletic shoe, various types of repair materials, such as rubber or other polymers, are commercially available. While still in a fluid or liquid state, these repair materials are applied to the worn areas of the shoe sole and then allowed to dry. This method of sole repair, however is disadvantageous for several reasons. First, upon drying, these repair materials are usually slick and smooth and cannot be provided with any type of tread pattern. Therefore, the ability of the athletic shoe to provide traction for its user is substantially inhibited, especially if a large area on the sole is repaired. Secondly, the application of these sticky substances is difficult and messy. Thirdly, use of this prior repair method results in a non-homogeneous shoe sole which may wear unevenly, resulting in additional frequent repairs. Finally, this repair method can also cause great inconvenience since the athletic shoe cannot be used while the repair substance is drying, which often requires up to forty-eight hours.

Another repair method of the prior art is analagous to retreading automobile tires. That is, the entire worn sole of the athletic shoe is removed from the upper portion and a new rubber sole is bonded thereto. This method, although providing the shoe with a new treaded sole which is complete and homogenous, is disadvantageous since it is expensive and requires the loss of the use of th shoe during the retreading process, which may take up to two weeks.

U.S. Pat. No. 3,019,534, to R. T. Kauffman et. al., discloses a shoe sole having replaceable out-sole and heel portions. The heel is attached to the out-sole which is in turn attached to a mid-sole by means of a transverse sliding engagement between numerous T-shaped ribs and inverted T-shaped grooves formed on each of these sole components. However, this shoe sole construction is completely unacceptable in the numerous instances where the lateral movement of the athletic shoe wearer is required since the transverse forces caused by such lateral movement could easily destroy the attachment between the components of the sole. Moreover, U.S. Pat. No. 2,183,277, issued to E. C. Heilhecker, shows a replaceable shoe sole; however, the attachment means and the in-sole on which they are mounted must be destroyed in order to repair the out-sole.

Thus, there is a need for an athletic shoe whose sole can be quickly, easily, and inexpensively repaired or replaced without the attendant disadvantages associated with these prior methods.

SUMMARY OF THE INVENTION

The present invention fills the void in the prior art by providing a shoe sole having a treaded out-sole member that can be quickly and simply snaped into or out of a mid-sole member, without the need for adhesives or other repair materials. If the tread on the out-sole should become worn or otherwise in need of repair, the athletic shoe can be inexpensively repaired by removing the worn out sole from the mid-sole and snaping in its place a duplicate, replacement out-sole having a new, freshly treaded bottom surface.

The mid-sole of the present invention is essentially U-shaped in cross section and can be securely attached to the upper portion of the athletic shoe by any suitable means, such as stitching or adhesion. This mid-sole serves as a base or anchor for the removeable out-sole which is substantially planar and has a treaded bottom surface. The out-sole is removeably attached to the mid-sole by means of a non-sliding, snap fit engagement between a ridge integrally formed on the upper surface of the out-sole and a matching groove or slot recessed in the bottom surface of the mid-sole.

The raised ridge on the out-sole is preferably and advantageously continuous; that is, it has no beginning or end. It is located parallel to and near the perimeter of the out-sole so that it takes on a similar, foot-shaped configuration. In one embodiment, the ridge is diamond shaped in cross section, although a mushroom shaped ridge, a rounded ridge or other cross sectional shapes are also possible. The upper portion of the ridge may have a pointed or blunt leading edge, and the lower portion is undercut to form a relatively narrow neck or base where the ridge is integrally formed on the top planar surface of the out-sole.

The continuous groove is formed in the bottom surface of the mid-sole so that it is aligned with the ridge on the out-sole, its cross sectional shape being substantially identical to the ridge on the out-sole. The opposite edges of the groove opening project toward one another to correspond to the undercut portion of the ridge, the width of the opening being just slightly larger than the width of the ridge's neck or base.

The matching cross sectional configurations of the ridge and the groove and the resiliency of the materials from which they are constructed provide a secure, removeable attachment of the out-sole to the mid-sole. The leading edge of the ridge facilitates insertion into the groove of the mid-sole, and the resiliency of the groove and the ridge material permits the widest portion of the ridge to be easily snaped into place within the groove. Once inside, the out-sole is held securely to the mid-sole by the interengagement of the projecting edges of the opening and the undercut portion of the ridge.

Of course, the degree of retentiveness of the out-sole by the mid-sole depends upon the amount of undercut in the ridge and the matching projection of the opposite edges of the groove opening. In the present invention, the length of the neck and the cross sectional shape of the ridge may be advantageously configured in order to provide the amount of undercut and out-sole retention that may be required by a particular activity. For example, a ridge having a long neck is typically very securely retained within the mid-sole because the corresponding edges of the groove opening are thicker and less resilient than those designed to receive a short necked ridge. Furthermore, a ridge cross sectional shape in which the upper surface of the under cut portion is horizontal, as in a mushroom shaped ridge, generally exhibits more retention than a ridge in which the upper surface of the under cut portion is tapered, such as in a diamond shaped ridge. Thus, in sports such as tennis and basketball, ridge shapes having longer necks and horizontal upper surfaces on the under cut portion may be required to provide a sufficient degree of retention; while in the sport of jogging, the retention provided by a ridge shape having a shorter neck and tapered upper surface on the under cut portion may be sufficient.

The degree of retentiveness, however, is generally inversely proportional to the ease of insertion and removal of the ridge. That is, the greater the retention, the more difficult it is to insert and remove the ridge, and vice versa. Thus, it has been found that a ridge neck having a width of one third to two thirds that of the widest portion of the ridge provides the optimum in both the ease of ridge insertion and removal, and in the security of the out-sole/mid-sole attachment.

Since the cross sectional shape of the ridge and groove are substantially identical, there is no slippage or movement of the two relative to one another during use of the athletic shoe. If the tread on the bottom of the out-sole should become worn, it can be quickly and easily replaced by removing the out-sole and snapping in its place a new one. The continuity of the ridge also facilitates this replacement; that is, if the ridge is removed or inserted at one point, the partial removal or insertion at adjacent points causes the groove opening to expand at these points to permit easy insertion or removal, and so on around the perimeter of the sole until the out-sole is either completely attached or removed. Furthermore, the continuous nature of the ridge and groove attachment prevents dirt, water, and other foreign elements from becomming lodged between the mid-sole and the out-sole.

The resiliency and flexibility of the present shoe is achieved by constructing the mid-sole and out-sole from a polyurethane resin material. Besides exhibiting these desirable qualities, it has been found that this material substantially outwears the rubber from which athletic shoe soles are usually made. In addition, the durability of the out-sole is increased even more by constructing it from a polyurethane resin having a greater hardness factor. The mid-sole is constructed from a polyurethane having a lower hardness factor in order to enhance its flexibility. In order to reduce the weight of the shoe sole of the present invention, the mid-sole can be constructed from a low density polyurethane foam or even from rubber, and a portion of the upper surface of the mid-sole can be relieved to decrease the amount of material in the mid-sole.

The mid-sole and out-sole of the present invention can each be integrally constructed from polyurethane material by use of conventional injection molding techniques using metal tooling. Or, they can be simply and inexpensively made from a casting process in which the molds are also made of polyurethane. In the later case, shrinkage is compensated for by an out-sole embodiment featuring a noncontinuous ridge. In this embodiment, the ridge is continuous except for a section located at the heel of the sole where a pair of short, longitudinal ridges are located. These ridges, which are aligned with a pair of matching grooves on the mid-sole, enable the out-sole to be securely attached to the mid-sole by taking into account any longitudinal shrinkage experienced by the out-sole and the mid-sole during their casting and construction.

Thus, the shoe sole of the present invention permits a worn out sole to be quickly, easily, and inexpensively replaced by simply removing it from the mid-sole and snapping in its place a fresh, duplicate out-sole. In addition to facilitating replacement and repair of the out-sole, the present invention provides a shoe sole in which various tread patterns can be selectively, interchangeably used on a single athletic shoe. For example, an out-sole bearing a tread pattern suitable for tennis can be replaced with an out-sole having a tread design for basketball or racquet ball. Subsequently, the tennis out-sole can be restored to the athletic shoe since there is no damage to the out-sole or the mid-sole in joining or separating these sole elements. Furthermore, this interchangeability advantageously permits the out-soles of various colors to be utilized for color coordination between athletic shoes and other clothing.

Finally, the out-sole of the present invention can be advantageously, easily removed to facilitate cleaning. For example, before entering a building or home with dirty shoes, the out-sole can be quickly snapped off from the mid-sole, easily cleaned, and then snapped back on. Alternatively, the out-sole can be replaced with a clean one, or the wearer need not replace the out-sole, preferring instead to utilize only the mid-sole. In the latter case, the mid-sole can also be provided with a tread pattern to produce traction for the wearer.

In conclusion, the shoe sole of the present invention offers several advantages not available with soles of the prior art.

DESCRIPTION OF THE DRAWINGS

FIG. 1 is a perspective view of an athletic shoe to which is attached the sole of the present invention, showing a portion of the out-sole broken away to reveal the groove recessed into the mid-sole;

FIG. 2 is a perspective view of the out-sole of the present invention clearly illustrating its continuous raised ridge;

FIG. 3 is a cross sectional, schematic view illustrating the interengagement between the out-sole and the mid-sole;

FIG. 4 is a cross sectional view illustrating the detailed construction of a diamond-shaped groove and ridge;

FIG. 5 is a broken away, cross sectional view illustrating an alternate rounded ridge configuration;

FIG. 6 is a broken away, cross sectional view illustrating the diamond shaped ridge configuration of FIG. 4 having a longer neck;

FIG. 7 is a broken away, cross sectional view illustrating a mushroom shaped ridge configuration; and FIG. 8 is a top plan view of an alternate out-sole which compensates for shrinkage.

DETAILED DESCRIPTION OF THE INVENTION

Referring to FIG. 1, there is shown an athletic shoe 10 including an upper portion 12 and the two-part sole 14 of the present invention, including an upper or mid-sole 16 and an out-sole 18 having a treaded bottom surface 20. A portion of the out-sole 18 is broken away to reveal the bottom surface 22 of the mid-sole 16 and a groove 24 located therein for the removeable attachment of the out-sole 18 to the mid-sole 16. As clearly shown in FIG. 1, the overall outline of the mid-sole 16 and the out-sole 18 are identical to form a compound sole 14.

The mid-sole 16 element of the shoe sole 14 of the present invention is preferably constructed of a low density polyurethane foam material having a hardness factor as measured on the Shore A scale (which is analogous to the Rockwell hardness scale for metals) of about 60–80. At this degree of hardness, the mid-sole 16 advantageously is lightweight, flexible and durable. Alternatively, the mid-sole 16 can be constructed from rubber or from a nonfoam polyurethane resin. The out-sole 18 is preferably constructed from a polyurethane resin having a Shore A hardness of about 70–90. At this degree of hardness, the out-sole 18 exhibits excellent qualities of durability and abrasive resistance. Although other polyurethane materials are possible, one specific example is Polyurethane System No. 20 manufactured by Poly-West, Inc. of Covina, Calif.

FIGS. 2, 3, and 4 illustrate the detailed construction of out-sole 18 and mid-sole 16 of the present invention. Although these elements are described in conjunction with a diamond shaped ridge, other ridge configurations are also possible, as will be explained below in more detail in connection with FIGS. 5, 6, and 7. Referring initially to FIG. 2, the out-sole 18 is shown having a raised ridge 26 integrally formed on its planar upper surface 28. The ridge 26 is located near the perimeter of the out-sole 18 and extends continuously thereabout. The continuity of this ridge 26 advantageously prevents dirt and other foreign elements from entering and becomming lodged in between the mid-sole 16 and the out-sole 18.

FIG. 3 illustrates the interengagement between the out-sole 18 and the mid-sole 16. As shown in this cross sectional view, the mid-sole 16 is essentially U-shaped, being attached at its sides 30 to the upper portion 12 of the athletic shoe 10 by means of stitching or adhesives (not shown). Preferably, the lower portion of the mid-sole 16, with the exception of the groove 24, is of a solid construction; although the central portion of the upper surface of the mid-sole 16 can be relieved, as shown in the dotted line 32 in FIG. 3, in order to reduce the weight of the mid-sole.

As shown in FIGS. 2 and 3, the out-sole 18 of the present invention is essentially planar, except for the diamond-shaped ridge 26 which mates into the groove 24 on the mid-sole 16. The out-sole 18 is firmly attached to the mid-sole 16 by means of the tight interengagement between the undercut portion of the ridge and the projecting edges of the opening of the groove, both indicated generally at 34 in FIG. 3. Because of the snug fit of the ridge 26 within the groove 24, there are no cavities in the interface between the out-sole 18 and the mid-sole 16 which could permit vertical movement of one with respect to the other. Furthermore, the continuous nature of the ridge 26 and the groove 24 also serves to prevent longitudinal and transverse movement of the out-sole 18 with respect to the mid-sole 16. This construction in the present invention produces a uniform shoe sole 14 which provides the same amount of security and traction as the one piece, integral shoe soles of the prior art, and additionally provides better durability.

FIG. 4 illustrates the detailed construction of the matching groove 24 and ridge 26, which are diamond-shaped in cross section. The narrow opening 36 of the groove 24 is formed by two opposing, projecting edges 38. The width of this groove opening 36 is just slightly larger than the width A of the base 40 of the ridge 26. The ridge 26 on the out-sole 18 is characterized by a sharp leading edge 44 which is formed by the sloping upper sides 42 of the ridge 26, each side 42 having a length B of about one quarter inch. The ridge 26 is further characterized by a wide, pointed midsection 46 and a narrower base 40 or neck where the ridge 26 is connected to the top surface 28 of the out-sole 18. A broad undercut portion 34 of the ridge is formed between the midsection 46 and the base 40 and provides, in connection with the projecting edges 38 of the opening 36 of the groove 24, a secure attachment of the out-sole 18 to the mid-sole 16. This undercut 34 is determined by the relative widths of the base 40 and midsection 46 of the ridge. Preferably, the width A of the base 40 is about one eighth of an inch while the width C of the midsection 46, which of course is the widest portion of the ridge, is about one quarter inch.

This construction of the shoe sole 14 of the present invention permits the ridge 26 on the out-sole 18 to be quickly and easily snapped into and out of the groove 24 in the mid-sole 16. In attaching the out-sole 18, the leading edge 44 of the ridge 26 initially permits easy insertion of the ridge 26 into the groove 24. The sloping upper sides 42 of the ridge 26 then bear against the projecting edges 38 of the groove 24 to spread apart and widen the opening 36 thereof, permitting passage of the midsection 46 into the groove 24. Furthermore, the flexibility of the midsection 46 and particularly the projecting edges 38 of the groove 24, permit the ridge 26 to be snapped completely into place within the groove 24 when a force is exerted on the bottom surface 20 of the out-sole 18 in a direction normal to the plane thereof.

The ease of insertion and removal and the security of the attachment of the out-sole 18 to the mid-sole 16 is related to the amount of undercut 34 on the ridge 26. That is, the greater or deeper the undercut 34, the more secure the attachment. However, at the same time it is more difficult to insert the midsection 46 of the ridge 26 within the groove 24 because of the correspondingly narrow groove opening 36. On the other hand, the smaller the amount of the undercut 34, the easier it is to insert the ridge 26 within the groove 24, but the attachment is less secure. The amount of undercut 34 can be measured by comparing the width A of the base 40 to the width C of the midsection 46. It has been found that a ratio of A to C of about one third to two thirds produces the optimum in ridge construction for both easy insertion and removal and secure attachment. This range of A/C ratios applies as well as to the ridges of FIGS. 5–7, although other ratios are possible which will produce satisfactory results. It should also be pointed out that the width A of the base 40 is sufficient to prevent the ridge 26 from wobbling during insertion within the groove 24. Furthermore, once the ridge 26 is completely within the groove 24 at one point, the edges 38 of the groove 24 at adjacent points flex open to facilitate the complete attachment of the out-sole 18 to the mid-sole 16. The same is true in reverse when the out-sole 18 is being removed from the mid-sole 16.

FIG. 5 illustrates an alternate ridge/groove construction which is essentially round. The rounded ridge 48 is connected to the out-sole 18 by means of a short, narrow neck 50, which also provides an undercut portion for securely attaching the out-sole 18 to the mid-sole 16.

FIG. 6 illustrates a diamond shaped ridge 58 similar to that shown in FIG. 4, except that it is connected to the out-sole 18 by means of a longer neck 60. This longer neck 60 permits the ridge 58 to be more securely retained in the mid-sole 16 because it provides for a higher undercut portion 62. That is, the attachment shown in FIG. 6 is very secure since the projecting edges 64 of the groove opening are thicker, stronger, and less resilient, and therefore require a greater withdrawal force than the ridge of FIG. 4 in order to detach the out-sole 18. On the other hand, the ridge 26 of FIG. 4 requires a lesser insertion force than that of FIG. 6. Furthermore, the stronger edges 64 are able to withstand many more in and out cycles of the ridge 58 without experiencing wear or erosion which could undermine the retentiveness of the ridge 58 within the mid-sole 16.

FIG. 7 illustrates a mushroom shape ridge 66. Besides being connected to the out-sole 18 by means of a long neck 68, similar to that of the ridge 58 of FIG. 6, this mushroom shaped ridge 66 is characterized by a blunt leading edge 60, sloping upper surfaces 72, a rectangular mid section 74, and a horizontal upper surface 76 on the under cut portion 78. The ridge 66 also exhibits good retentiveness in the mid-sole 16 because of the thick under cut portion 78 provided by the long neck 68, and particularly because of the flat upper surface 76 on the under cut portion 78. Furthermore, this retentiveness is enhanced by the thick, rectangular mid section 74 which provides rigidity, great durability to withstand many in and out cycles. The blunt leading edge 70 advantageously reduces the overall height of the ridge/groove combination, reducing the weight of the shoe sole of the present invention and permitting it to more closely approximate the thickness of a single element sole. At the same time, the leading edge 70 facilitates insertion of the ridge 66 since it is narrower than the groove opening, as shown in FIG. 7.

Thus, in sports where excellent retention of the out-sole by the mid-sole is required, the ridge configurations of FIGS. 5, 6, and 7 are preferable since they are provided with large under cut portions. On the other hand, in sports where less retention is desired, and perhaps more ease of insertion and removal, the ridge of FIGS. 3 and 5 is advantageous.

FIG. 8 illustrates an alternate out-sole 52 having a noncontinuous ridge 54. The ridge 54 is discontinuous at the heel portion where a pair of short longitudinal ridges 56 are located. This redge 54 orientation permits the out-sole 52 of FIG. 8 to compensate for any shrinkage experienced by the out-sole or mid-sole during the casting process. Since this shrinkage usually occurs in a longitudinal direction, the short ridges 56 permit the out-sole 52 to be attached to the mid-sole even though the overall length of the larger, main ridge 54 does not perfectly match that of the mid-sole. The mid-sole is also provided with matching parallel grooves (not shown). The cross sectional shape of the ridge of FIG. 8 can be those of FIGS. 4 through 7, or other equivalent cross sections.

Thus, in conclusion, the shoe sole of the present invention provides a removable out-sole which can be quickly and inexpensively replaced by means of a simple snap fit interengagement between a ridge on the fresh out-sole and a groove on the mid-sole. Besides providing a simple means for the repair and replacement of one tread, the shoe sole of the present invention permits ready interchangeability in tread patterns and out-sole colors. Furthermore, the ridge can be cycled into and out of the groove many times without damage to either the mid-sole or the out-sole, thereby permitting reusability of the out-sole of the present invention.

What is claimed is:

1. An athletic shoe adapted to receive interchangeable, treaded bottom surfaces which are suitable for use in a variety of athletic activities, comprising:

an upper shoe portion to receive the foot of the user of said athletic shoe;

a mid-sole securely attached to the bottom surface of said upper shoe portion, said mid-sole having a substantially continuous groove recessed into the bottom surface of said mid-sole with an opening thereon; and an out-sole removably attached to and superimposed on said mid-sole to form a unitary sole on said athletic shoe, said out-sole comprising:

a treaded bottom surface to provide traction to said shoe; and a substantially continuous ridge formed on a top surface of said out-sole, said ridge being aligned with and inserted into said groove in said mid-sole to provide snap-fit engagement means between said mid-sole and said out-sole for removably attaching said out-sole to said mid-sole and for selectively permitting removal and replacement of either said out-sole or other similarly constructed out-soles.

2. The athletic shoe of claim 1 wherein the width of said ridge at its widest point is greater than the width of the opening of said groove to provide means for anchoring said out-sole to said mid-sole when said ridge is located within said slot.

3. The athletic shoe of claim 2 wherein said opening of said groove is resiliently deformable for selectively permitting insertion and removal of said ridge and the reusability of said out-sole.

4. The athletic shoe of claim 1 wherein a portion of said ridge is undercut and a corresponding portion of said groove protrudes, said undercut and protruding portions engaging to retain said ridge with said groove.

5. The athletic shoe of claim 4 wherein said ridge is essentially diamond-shaped in cross section, said undercut portion being formed by a wide mid-section and a narrower base.

6. The athletic shoe of claim 5 wherein the width of said base is one-third to one-half the width of said mid-section.

7. The athletic shoe of claim 4 wherein the cross sectional shape of said ridge is rounded.

8. The athletic shoe of claim 1 wherein the upper surface of said mid-sole is releived to decrease in the weight of said athletic shoe.

9. The athletic shoe of claim 1 wherein said out-sole is constructed from a flexible polyurethane resin.

10. The athletic shoe of claim 9 wherein said mid-sole is also constructed from a polyurethane resin.

* * * * *